US006786272B2

(12) United States Patent
Cowie et al.

(10) Patent No.: US 6,786,272 B2
(45) Date of Patent: Sep. 7, 2004

(54) APPARATUS AND METHOD FOR DIE CASTING

(75) Inventors: John G. Cowie, Forest Hills, NY (US); Dale T. Peters, Hilton Head Island, SC (US); Edwin Brush, Weston, MA (US); Kenneth P. Young, Englewood, CO (US); Stephen Midson, Denver, CO (US); Jack Daugherty, Winchester, MA (US)

(73) Assignee: Copper Development Association, Inc., New York, NY (US)

( * ) Notice: Subject to any disclaimer, the term of this patent is extended or adjusted under 35 U.S.C. 154(b) by 0 days.

(21) Appl. No.: 09/727,088

(22) Filed: Nov. 30, 2000

(65) Prior Publication Data

US 2002/0062941 A1 May 30, 2002

(Under 37 CFR 1.47)

(51) Int. Cl.[7] ..... B22D 17/10; B22D 19/04; B22D 27/04

(52) U.S. Cl. ..... 164/103; 164/105; 164/113; 164/338.1

(58) Field of Search ..... 164/103, 105, 164/113, 312, 121, 338.1, 72

(56) References Cited

U.S. PATENT DOCUMENTS 3,615,880 A * 10/1971 Barto et al. ..... 148/321
5,332,026 A 7/1994 Thieman et al.
5,937,930 A * 8/1999 Nakamura et al. ..... 164/112

OTHER PUBLICATIONS

Benedyk, et. al.; :(1970) "Thermal Fatigue Behavior of Die Materials for Aluminum Die Casting", The Society of Die Casting Engineers—SDCE International Die Casting Congress—Paper No. 111, Cleveland Ohio, Nov. 10–19, 1971.

Herman, et. al.: "opper Alloy Pressure Die Casting"—International Copper Research Association, New York, New York, p. 52, 1975.

Doehler, H.H.: "Die Casting "—McGraw–13 Hill Book Co. Inc, New York New York, p. 163–165, 1951.

Rumberger, W.M.: "Investigation of Materials for Use in Copper Alloy Die Casting Dies"—International Research Association Project No. 59, Mar. 1966.

* cited by examiner

*Primary Examiner*—Kuang Y. Lin
(74) *Attorney, Agent, or Firm*—Chadbourne & Parke, LLP

(57) ABSTRACT

The present invention provides a method and apparatus for die-casting copper and other metals that are cost-effective and practical for production use in die-casting, for example, copper motor rotors. In motor rotors, the incorporation of die-cast copper for conductor bars and end rings in place of aluminum is known to result in improvements in motor energy efficiency. Previous attempts to die-cast copper motor rotors in a commercially feasible manner have failed because copper's high melting point places too great a stress on the die material, resulting in cracking and fracturing of the molds. High temperature die materials such as nickel, tungsten and molybdenum based alloys with a high melting point are employed, and a die casting apparatus is provided to pre-heat the molds prior to injection of the molten copper. Pre-heating and high operating temperatures provide extended die life. By preheating, the die materials experience reduced cyclic stresses associated with thermal expansion, because the thermal shock that results from the difference in temperature between the molten copper and the surface of the mold is reduced, ideally below the yield strength of the mold material. Extended die life provides the opportunity for economically viable copper motor rotor die-casting.

21 Claims, 6 Drawing Sheets

APPARATUS AND METHOD FOR DIE CASTING

FIELD OF THE INVENTION

The present invention relates to die casting and more particularly to preheating components of the die when casting in order to improve the process and life of the die materials.

BACKGROUND OF THE INVENTION

Die-cast motor rotors are universally produced in aluminum by pressure die-casting. That is a well-established and economical method. While copper possesses more attractive conductivity properties, leading to significantly greater motor efficiency, only small numbers of very large motors utilize copper in the rotors by mechanical fabrication. Tool steel molds that are used for the aluminum die-casting process have proved to be entirely inadequate when casting higher melting point metals including copper because they lack long die-casting life-in-service as they are unable to withstand the associated thermal stresses. Lack of a durable and cost-effective mold material has been the technical barrier preventing manufacture of the die-cast copper rotor, as well as die-casting for other high melting point and high heat capacity metals, such as stainless steel.

Die-casting, when it can be performed, is widely recognized as a low cost manufacturing process. For these reasons, die-casting has become the fabrication method of choice and aluminum the conductor of choice in almost all but the largest frame motors.

Die-cast copper rotors can provide advantages to motor manufacture and/or performance in at least the following ways: (i) improving motor energy efficiency in operation, (ii) reducing overall manufacturing cost, and (iii) reducing motor weight. Motor efficiency is a measure of the amount of power generated versus the amount of power input. Motors losses result from at least primary (i.e. stator winding) $I^2R$ loss (usually 34% to 39%), secondary (i.e. rotor) $I^2R$ loss (usually 16% to 29%), iron (core), friction and windage, and stray load. Since the late 1970s, when many aluminum stator windings were replaced by copper, there has been a focus on improving the operating efficiency of motors. Newer motor designs have recently improved efficiencies by increasing the amount of copper in windings, additional core and copper coil size, reduced windage losses, improved core steel, etc. However, the rotor remains die-cast aluminum because aluminum has a relatively low melting point of 660° C. (compared to 1081° C. for copper), and therefore that does not pose a hazard to the integrity of the mold, and because long-lived molds able to withstand repeated high thermal stresses are either not available or not commercialized.

Copper Conductive Rotors ("CCR's") reduce rotor loss, in addition to achieving overall motor re-optimization of iron, strays, etc. CCR-based designs show overall loss reduction from 15% to 20%. Aside from the higher efficiency (92.5% versus 91% for "premium" efficiency motors), CCRs in today's premium energy efficient (EE) motors can cost approximately 5 to 8% less to manufacture than the current comparable EE motor, and/or produce a motor of comparable EE that weighs 5 to 10% less than the same energy efficient motor with traditional aluminum core rotors.

According to the study "Classification and Evaluation of Electric Motors and Pumps" DOE/CS-0147 published February 1980, sponsored by the US Department of Energy, motors above ⅙ horsepower ("Hp") used about 60% of the electricity generated in the United States. When extrapolated worldwide, the potential economic and environmental benefits of improving the efficiency of motors by using copper rotors in place of aluminum rotors are substantial. Medium horsepower motors, that is, those in the one to one hundred twenty five Hp range (approximately 0.75 to 100 kW range), use about 60% of the electricity supplied to all motors in the US. Because of the proliferation of electric motors in this horsepower range, the projected energy savings by using the copper rotor motor is a significant national consideration. Efficiency increases (a function of motor size) from improved electrical conductivity are projected to result in total US energy savings in the year 2010 of 20.2 E+12 Btu/yr at only 10% market penetration and 143 E+12 Btu/yr at a market penetration of 50 to 70%.

CCR could be utilized to reduce rotor $I^2R$ losses in an existing motor design, replacing the existing die-cast aluminum rotor, without re-designing the motor to include more/better quality core, more stator windings, etc., which are the existing methods of improving motor energy efficiency in operation. CCR's can be used in specific motors to achieve a multiplicity of intermediate combinations of these design advantages. For example, where a smaller efficiency increase is required, the CCR could be used to achieve some reduction in manufacturing cost (stator winding, core, etc.) than would otherwise have been the case with traditional aluminum die-cast rotor technology.

The problem encountered in attempting to die-cast copper motor rotors is thermal shock and thermal fatigue of mold materials. Thermal cycling of the mold surface limits the mold life even in aluminum die-casting. Even when the steel mold material is pre-heated, often by circulating hot oil through the die so that it reaches about 250° C., the $\Delta T$ with 1081° C. copper still far exceeds the yield strength of steel. That results in cracking ("heat checking") of the die material. Over repeated casting shots, the tiny cracks grow into larger fractures.

Die-cast motor rotors are typically produced using aluminum because rotor fabrication by pressure die-casting in aluminum has proven to provide cost effective methods and materials for commercially feasible production runs. Copper rotors have typically not been produced because the melting temperature for copper is substantially higher than aluminum, resulting in thermal shock when the copper contacts the steel mold that greatly exceeds the yield strength of the mold material, which leads to commercially unacceptable rates of heat checking, i.e., short steel mold life-in-service, or cracking of the mold due to thermal stress. A low initial temperature of the die results in a large $\Delta T$ at the surface of the die, and thus the stress in the die, on each shot. The high melting temperature, high heat of fusion, substantial latent heat and high thermal conductivity of copper combine to maximize the thermal shock.

Lack of durable and cost-effective mold material, and in particular a proven method for die casting with higher melting point electrically efficient materials has been a barrier preventing manufacture of the die-cast copper rotor. It is well known, however, that incorporation of copper for the rotor conductor bars and end rings in the induction motor in place of aluminum would result in attractive improvements in motor energy efficiency due to copper's exceptional electrical conductivity.

It is therefore an object of this invention to provide a commercially feasible method for die-casting high temperature, high performance materials such as copper that will avoid the heat checking and cracking in the mold due to thermal shock of the mold that occurs under traditionally practiced methods of die casting.

It is a further object of this invention to provide processing conditions designed to withstand the copper motor rotor die-casting environment for an commercially and economically acceptable mold material life-in-service.

It is a further object of this invention to provide a die-casting apparatus to facilitate commercial die casting of copper motor rotors.

It is a further object of this invention to employ the die-casting apparatus to die-cast copper on suitable mold materials, such that the thermal shock to the mold material does not result in exceeding its yield strength.

SUMMARY OF THE INVENTION

As a starting point, the solution to the thermal shock problem lies in the use and creation of high temperature mold materials having thermal and thermo-elastic properties conducive to minimizing thermally induced strain. Even the most resilient known mold materials, however, cannot withstand repeated thermal shock associated with die-casting of molten copper at 1081° Celsius. The present invention is directed to overcoming the current obstacles to die casting copper, by providing an apparatus and method capable of pre-heating the mold inserts to an elevated temperature to reduce the thermal differential between the die mold and the molten copper capable of overcoming the thermal shock problem and enable commercially feasible die casting of copper.

In particular, the present invention is directed to providing mold inserts including resistive heaters capable of pre-heating the mold to an elevated temperature to reduce the thermal differential between the die and the molten copper, then pre-heating the material to be cast to a temperature at which the thermal shock from the molten copper is less than the yield strength of the mold material into which it is being cast, injecting the material into the die-cast mold, and allowing the material to cool to a temperature below the melting point. As detailed below, the mold inserts that are the focus of the present invention are inside the master mold assembly, which assembly is generally made of steel and can weigh in excess of ten tons. The mass of the master mold assembly ensures that there will be adequate clamping pressure on the mold inserts to overcome the injection force of the molten material in operation and keep the mold inserts closed. The mold inserts, which are shaped and actually comes into contact with and forms the molten material, are made of a suitably strong material to withstand the heat of molten copper, for example. They are the portions of the master mold assembly that are pre-heated in order to prevent heat-checking, while the master mold, which is generally made of steel and absorbs the heat from the mold insert that it envelops, may be cooled in order to prevent the steel from re-annealing and gradually losing its shape. One or more mold inserts may be used, preferably two halves comprising the runner through which the molten material flows into the die, two inserts for the end rings, and a cylinder surrounding the core stack of laminations.

Preheating the mold inserts decreases the thermal differential between the molten copper and the mold material, lessening the thermal shock to the mold when contacted by the high temperature of molten copper. It is essential that the mold be pre-heated to a temperature at least at which thermal shock caused by the thermal differential between the molten copper and the pre-heated mold is below the yield strength of the material, otherwise cracking will occur. Ideally, the pre-heat temperature will be higher than that temperature to allow for anticipated flaws in the mold material or in the mold, which can lead to part of the interior of the mold inserts having a lower yield strength than the others. So long as the yield strength of the mold material is not exceeded as a result of the thermal differential when the molten copper is injected, there is no discernible benefit to pre-heating to any higher temperature to approach the melting point of copper, for example. Indeed, the higher the temperature to which the mold is pre-heated, the longer it will take for the molten copper to cool, extending the time for each casting, which is commercially undesirable. To the extent possible, then, the ideal temperature for pre-heating the mold would be just above that at which the thermal shock associated with the application of molten copper exceeds the lowest yield strength of the mold material. That would optimize the time period for cooling while still ensuring that the mold will not crack as a result of the thermal shock from molten copper.

This longer mold life removes the obstacle to mass production of copper motor rotors, and allows for commercially feasible production of rotors having die-cast copper conductor bars and end rings in the induction motor in place of the traditional aluminum, which yields attractive improvements in motor energy efficiency due to copper's high electrical conductivity.

BRIEF DESCRIPTION OF THE DRAWINGS

The foregoing and other features and advantages of the present invention will become more apparent in light of the following detailed description of exemplary embodiments of the invention, as illustrated in the accompanying drawings, where.

DETAILED DESCRIPTION

Figure 1:
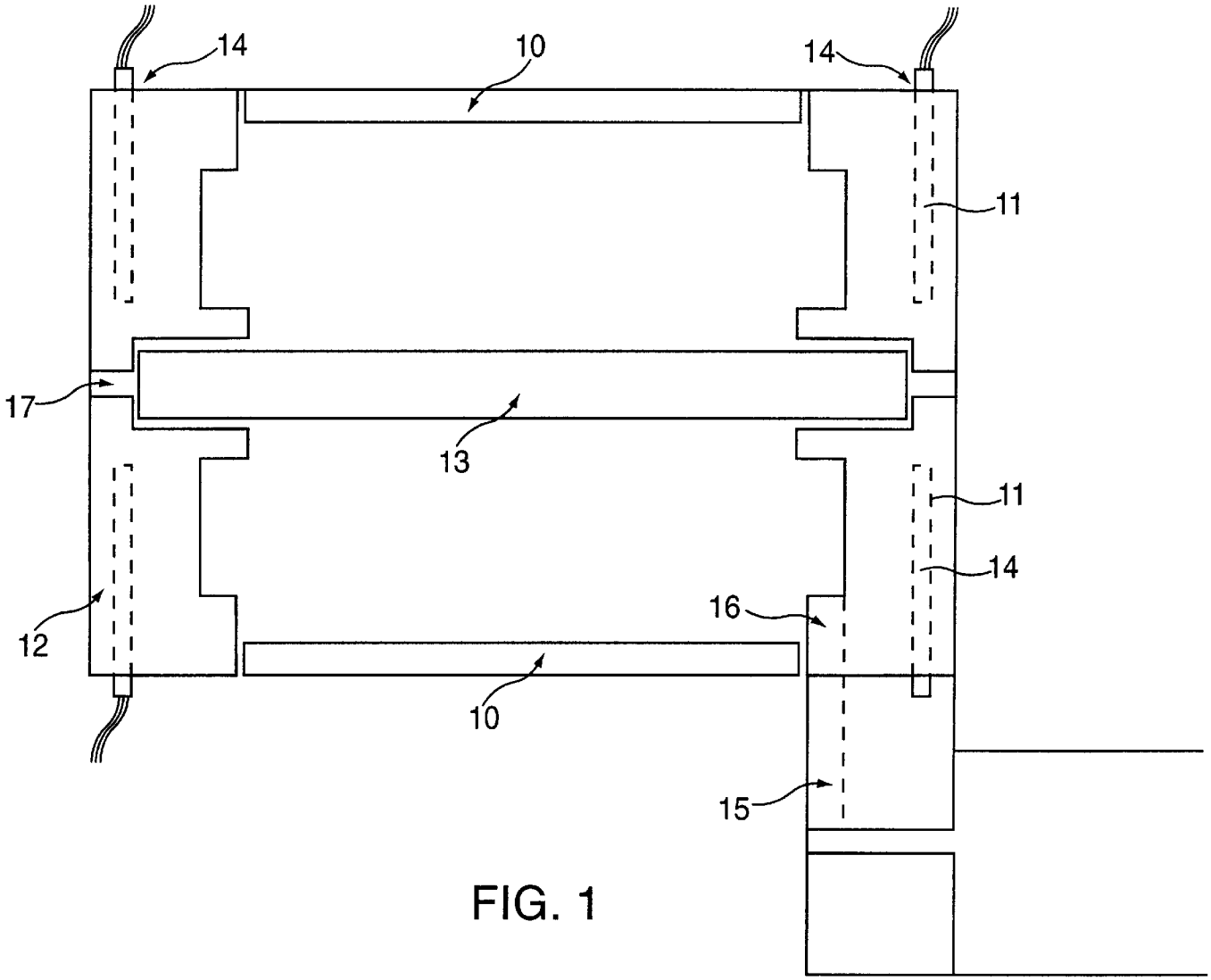
FIG. 1 shows a die casting apparatus according to an embodiment of the present invention.
Figure 2:
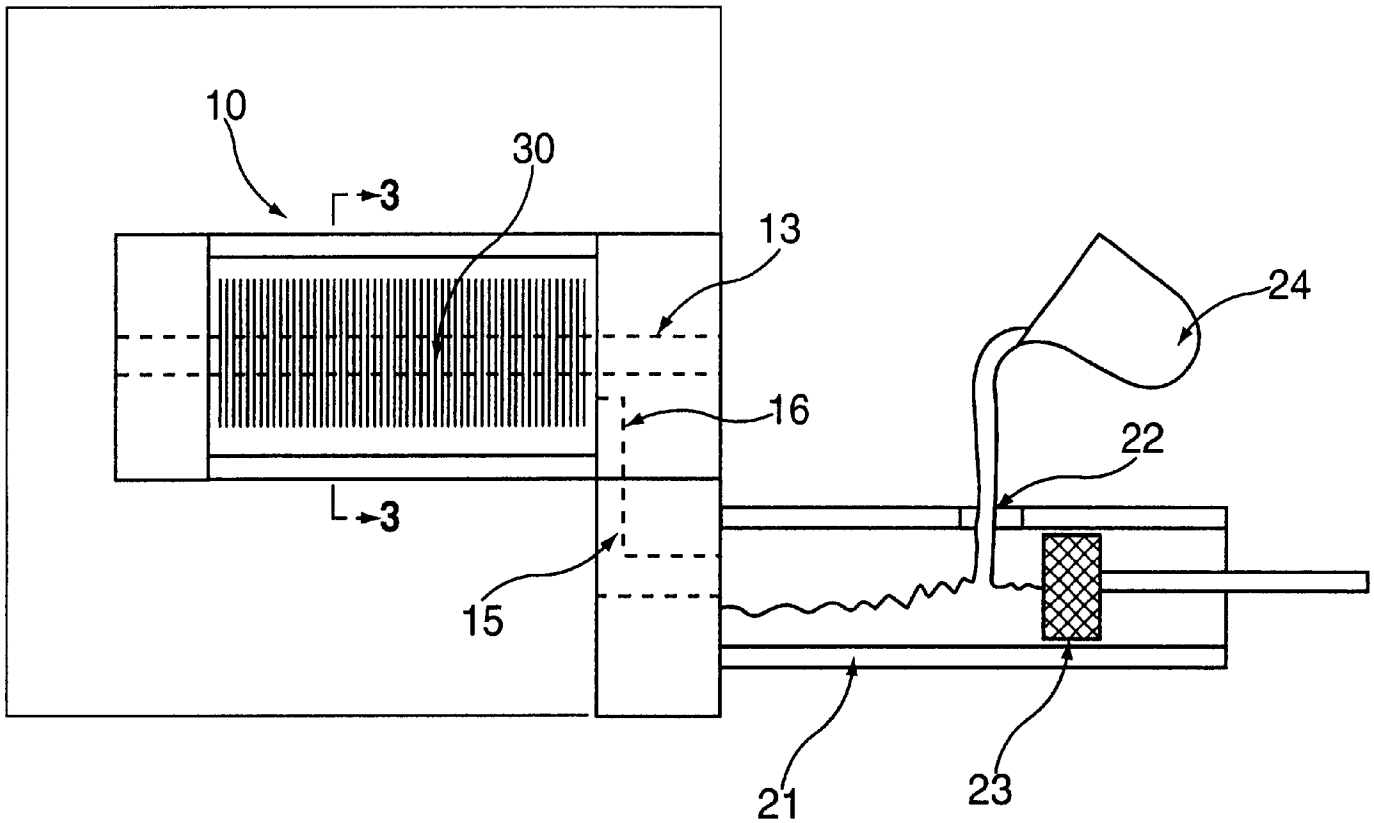
FIG. 2 is a side-view representation of the molten material being poured into the die-casting apparatus according to an embodiment of the present invention.

As illustrated in FIG. 1, an embodiment of the present invention includes a cylindrical die insert set 10, made up of one or more insert pieces, for molding the rotor. Shown in a horizontal cross-section, the die set 10 is coated to prevent adhesion by the molten copper. The die includes gate plates 11 at one end and symmetrical end plates 12 at the other, and an arbor 13 running through the center, which acts as a support for the core stack to produce the die cast rotor. The arbor 13 is coated with a non-conductive oxide to prohibit electrical conductivity. Cylindrically shaped electrically resistive heaters 14, such as, for example, the commercially available cylindrical one half-inch diameter 2000 watt Fire Rod cartridges sold by Watlow, are inserted into drilled sections of each of the end plate 12, gate plate 11 and the runner 15 to pre-heat the die 10 before injection of the molten copper. Each of the end plate 12, the gate plate 11, and the runner 15 may be provided as separate insert pieces of the die set 10. The runner 15 is a channel through which the molten material is injected into the mold. It leads into the die set 10 at the gate plate 11, which has a gate 16 that opens into the interior of the die set 10. A vent 17 at the opposite end of the die 10, near the end plate 12, allows air to escape when molten material is being forcibly injected into the die cylinder. As shown in FIG. 2, the runner 15 opens to the shot chamber cylinder 21, which includes a pour hole 22 and a piston 23 for filling the shot chamber 21 and runner 15 and forcibly injecting the molten copper through the gate 16 and into the interior of the cylindrical die 10.

It should be noted that while copper is discussed in these and other embodiments as the material being die-cast, any material having a high melting point, or selected materials having a lower melting point in which mold life may be shortened due to heat checking, may be able to be die-cast according to the present invention.

Figure 3:
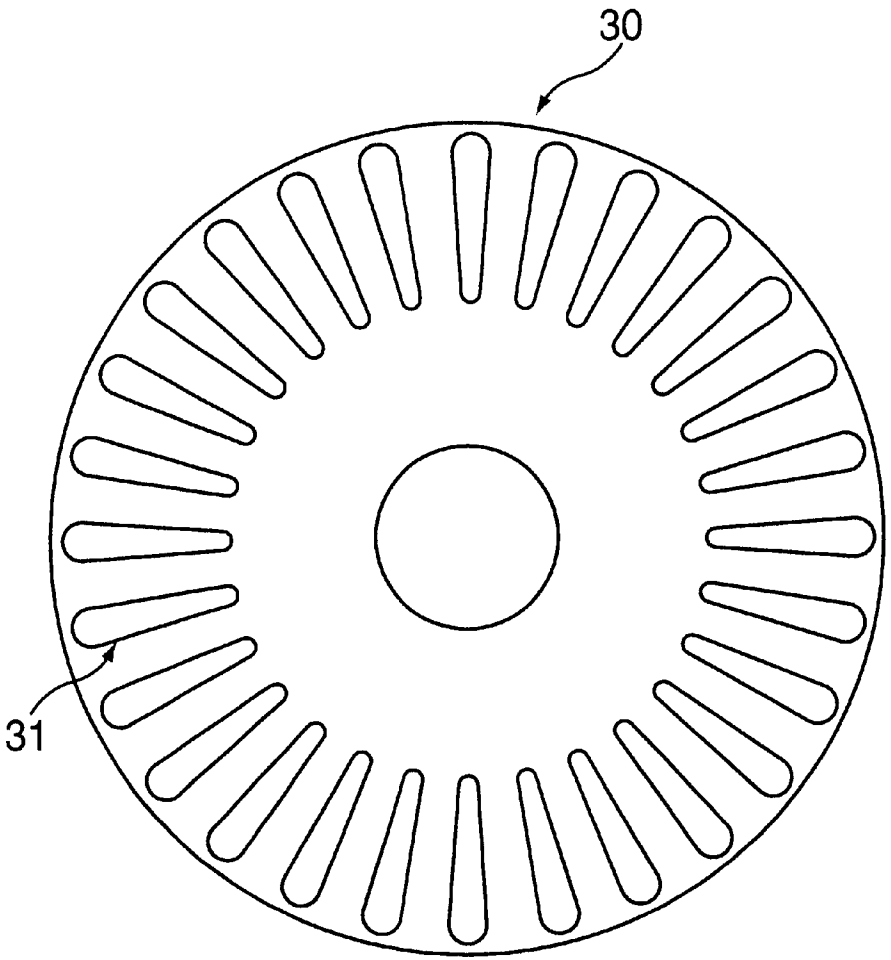
FIG. 3 is a diagram depicting a lamination according to an embodiment of the present invention.

Prior to injection, the die is loaded by placing a stack of laminations 30 around the arbor 13, and the arbor 13 is fixed into place inside the die cylinder 10. A cross sectional view A—A of the assembled die set 10 shown in FIG. 3 depicts a single lamination 30 from the interior stack. The holes 31 in the laminations 30 are substantially aligned to form the channels through which the molten copper is injected. Like the arbor 13, each lamination 30 is coated with an oxide to prevent electrical conductivity. Still before injection, the die 10 is pre-heated in preparation for receipt of the injection of copper. While the exact temperature for the die 10 will depend on the particular mold material, the pre-heat temperature must be at least that at which the thermal shock resulting from the difference in temperature between the molten copper and the pre-heat temperature is less than the lowest yield strength of the mold material. Ideally, the preheat temperature will be no higher than that in order to optimize the time for cooling of the injected copper to allow for as many rotors as possible to be cast. Also, given that the exterior of the mold is open to the air, it loses heat quickly over a relatively large surface area, so it would be difficult to maintain too high a pre-heat temperature, even if that were desirable, which it is not.

Figure 4A:
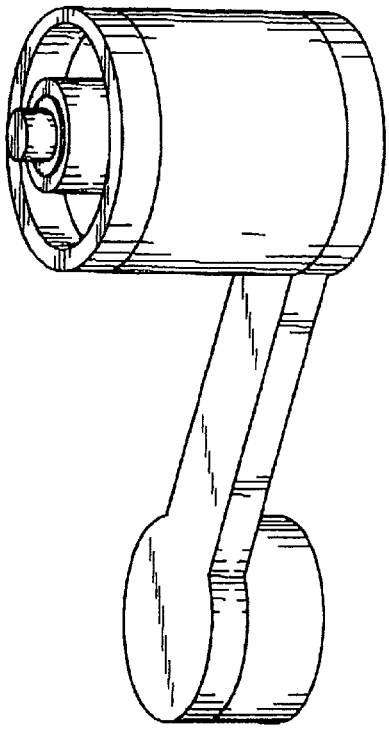
FIG. 4 is diagram showing an overhead view of the die assembly according to an embodiment of the present invention.
Figure 4B:
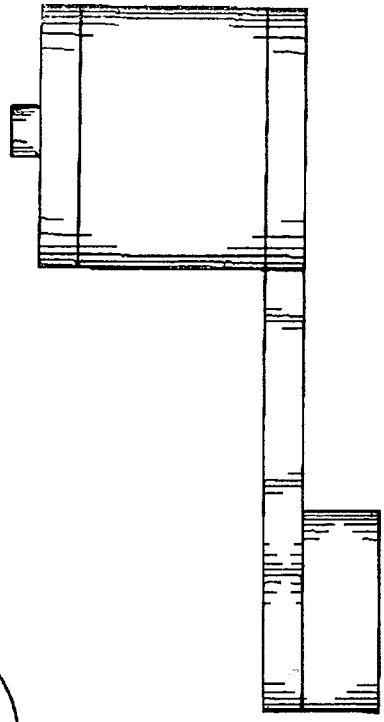
Figure 4C:
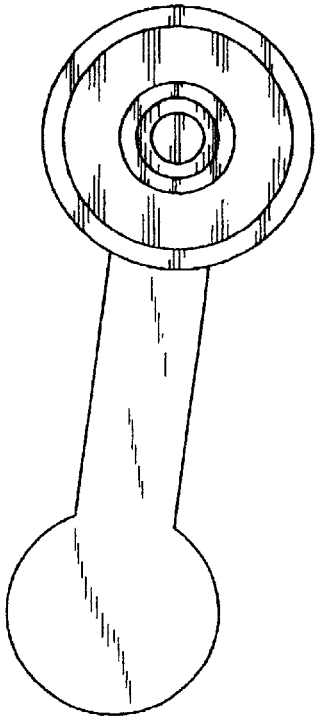

As shown in FIG. 2, copper, which has a melting point of approximately 1081° Celsius, may be super-heated by induction in a crucible 24, preferably ceramic, to a slightly higher temperature to allow time for it to be injected into the die 10 and retain its molten state while being injected before cooling and solidifying. The quick heating of the copper by the induction method minimizes the amount of air that mixes with the molten copper prior to injection into the mold. The molten copper is then poured into the shot chamber 21. The piston 23 moves slowly at first to fill the shot chamber 21 and then the runner 15 so as to avoid trapping any air, then it accelerates to forcibly inject the molten material through the gate 16 into the pre-heated cylindrical die 10. At that point, the piston is moving approximately 4 m/s and creating a pressure of approximately 520 bar. overhead view of the die assembly is shown in FIG. 4. The shot chamber 21 holds the molten copper, which is forcibly injected through the runner 15 and the gates 16 into the die cylinder 10, filling through the holes in the laminations 30 stacked over the arbor 13.

Parameters that influence charging of the die with molten materials are the stroke speed of the piston 23 in the shot chamber cylinder 21 and the pressure created by the piston 23. These parameters may be varied to optimize the fill characteristics of the die. The size and shape of the die 10, as well as the casting material will influence the stroke speed and pressure settings needed for an optimum fill of the die.

The copper passes through the runner and enters the cylindrical die 10 through the gate 16 within the gate plate 11 and quickly fills the empty portion of the cylindrical die 10 consisting of the two ends and the openings in the stacked laminations, to form the rotor 40. The copper injected rotor is allowed to cool to a solidified temperature, and the master die assembly is then opened, and the die-cast rotor may be removed and placed into a quenching tank of water.

Figure 5:
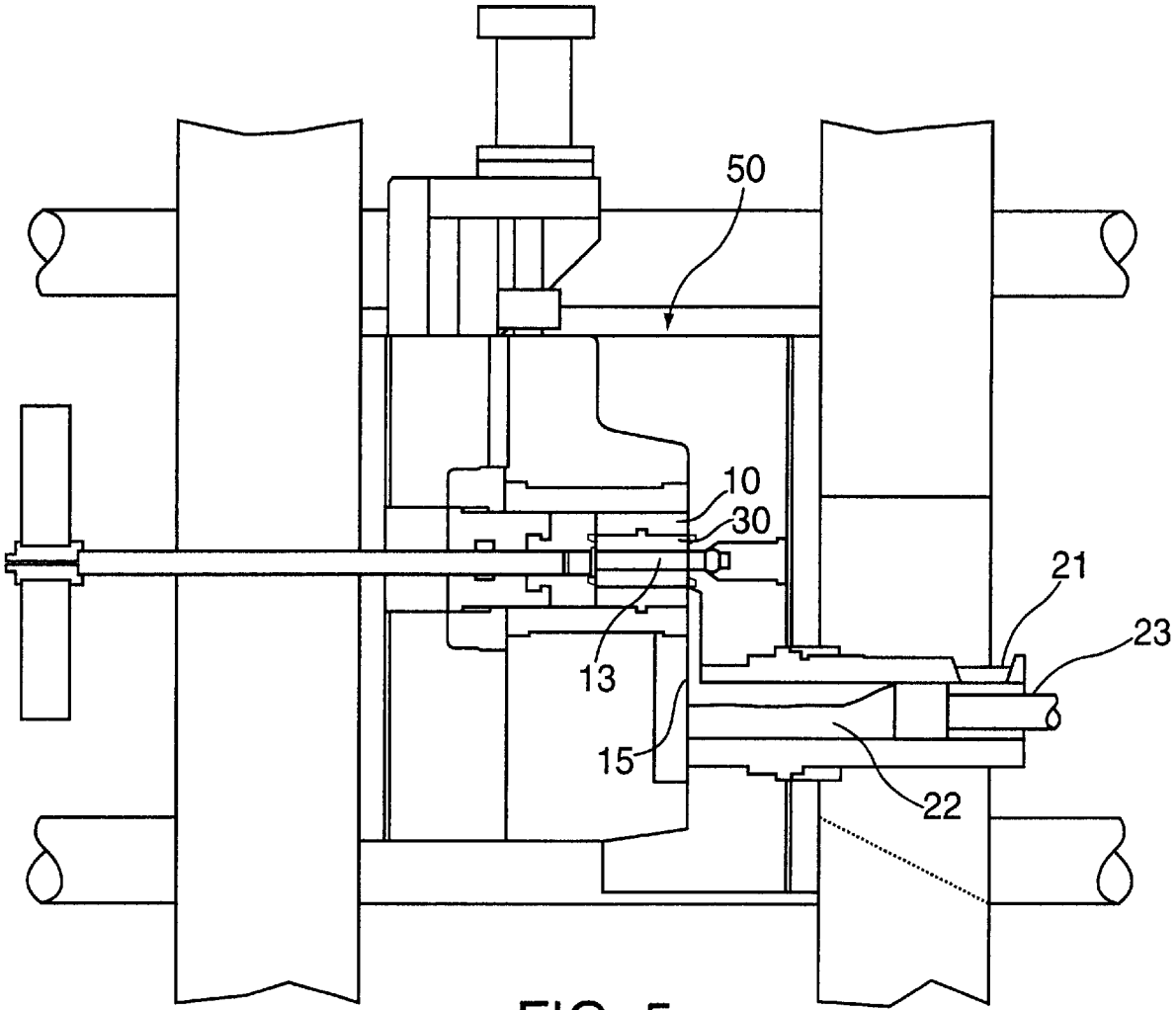
FIG. 5 shows the entire mold assembly including the mold inserts during injection of the molten material according to an embodiment of the present invention.
Figure 6:
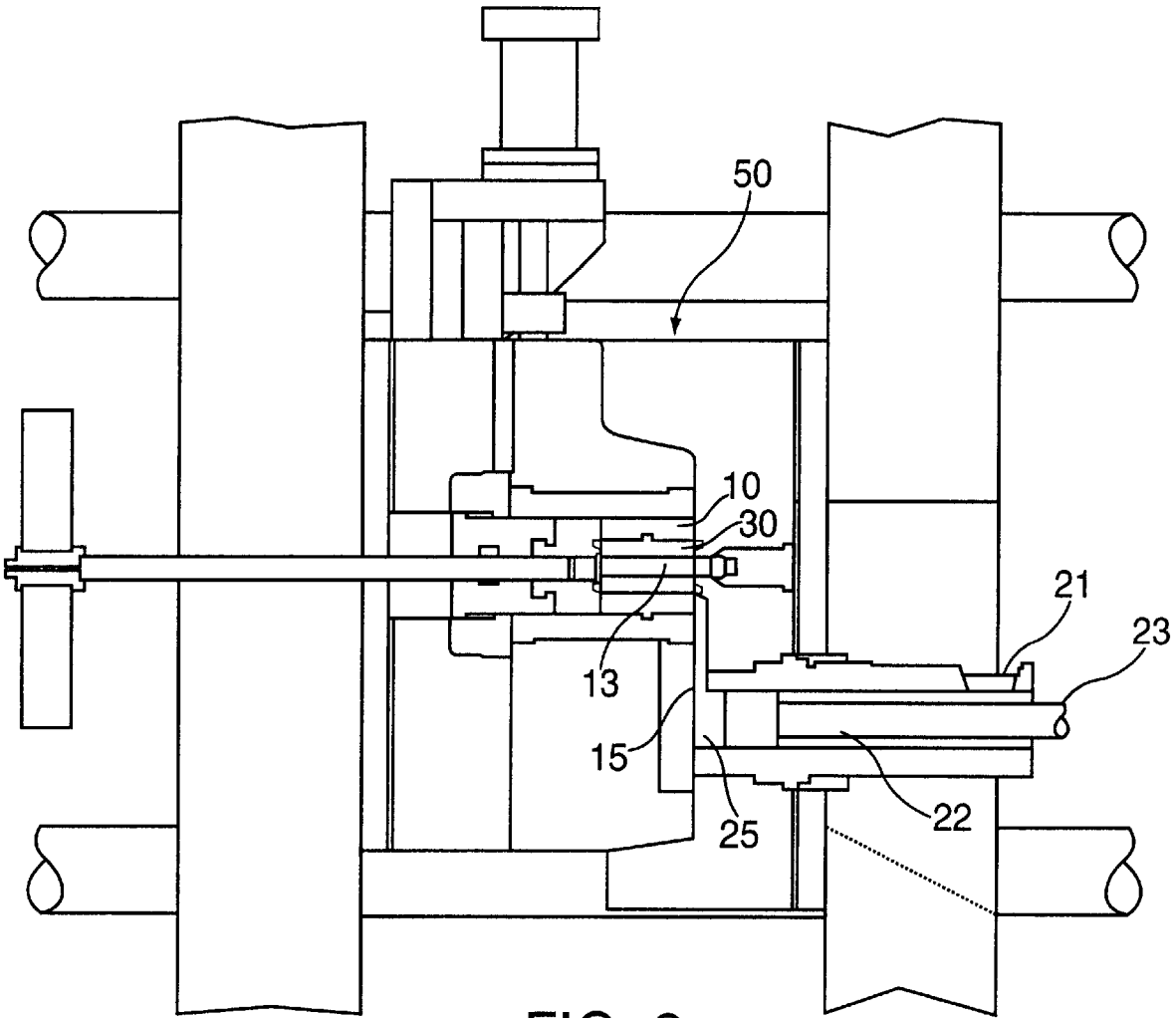
FIG. 6 shows the mold assembly of FIG. 5 after injection has been completed according to an embodiment of the present invention.

The master mold, which is typically made of steel, should be allowed to cool to prevent the steel from re-annealing. The master mold 50 is shown in FIGS. 5 and 6 in different stages of the die-casting process. FIG. 5 shows the master mold 50 surrounding the die insert set 10, which in turn surrounds the stack of laminations 30, also known as the core stack. The piston 23 is partially advanced through the shot chamber 21, completing the fill of the shot chamber 21 with the molten material 22. FIG. 6 shows the master mold assembly 10 also shown in FIG. 5, with the piston 23 fully extended through the shot chamber 21, and the molten metal throughout the runner 15 and the interior of the die insert set 10, forming the completed die cast part. After several shots with the mold insert heated to over 600° C., the master mold 50 will heat up as a result, and will have to be cooled. The longer the master mold 50 takes to cool, the less shots that the mold can be used for in a given time frame. The manufacturer may therefore choose to actively cool the master mold die 50 to increase the production rate (but also increase the complexity and expense of the device, by adding a cooling element), to prevent the master mold steel from re-annealing and potentially losing its shape.

The hotter the pre-heat temperature chosen for the die insert, and the more shots giving the master mold time to absorb the heat, the longer the cool down period for the master mold by natural convection, so it appears more appropriate to choose to actively cool the master mold. One method of actively cooling involves forced air convection, and another is to circulate a coolant in tubes around or through the master mold. Since increasing the number of die cast parts produced for a given system is commercially desirable, actively cooling may be a worthwhile consideration.

Insulation material is positioned between the master mold and the mold inserts, to minimize heat transfer to the master mold to prevent overheating in the master mold and potential re-annealing of the steel, and to permit the mold inserts to achieve the required elevated temperatures with the assistance of the heaters.

Copper die cast motor rotors would result in attractive improvements in motor energy efficiency. Advances have been made toward the development of durable and cost effective mold materials, presently the last major hurdle preventing die-casting of the copper rotors. But not all mold materials are suitable for die casting copper. The material must be capable of being pre-heated to an elevated temperature according to the present invention without compromising its integrity. Tool steel, for example, which is the current commercial mold material of choice for die-casting aluminum, cannot be pre-heated to a high enough temperature for copper die-casting without undergoing phase transformations and losing its integrity as a mold. An extended run of copper against Inconel and the tungsten alloy Anviloy mold materials was accomplished without major heat checking. With the technique of reducing the thermal differential through pre-heating the mold material to high temperature, reducing the thermal shock when contacted by the copper, several high performance materials may have long-life in copper motor rotor die-casting. The following are certain examples of testing performed on various mold materials using embodiments of the apparatus and method according to the present invention:

H-13 Tool Steel

The first copper die-casting trial was conducted using the H-13 steel die inserts. As expected, the dies generally degraded with increasing usage. Since steel undergoes phase transformations at relatively low temperatures (above approximately 500° C.) and loses strength at molten copper temperatures, it is not possible to employ the method of the present invention to reliably heat the steel to a temperature at which the thermal shock caused by the molten copper is reduced below the yield strength of the steel.

Several copper die castings from the tool steel mold were metallurgically, chemically and physically analyzed. The gate and runner macrostructures showed an outer columnar chill zone and a mixture of equiaxed and columnar grains in the bulk. The microstructures also showed the presence of an interdendritic phase of steel caused by a phase transformation. Surface cracks and tears were found in the gate sections, in general the number and depth increased with shot number. Internal defects resembling oxide films, macroscopic pores and slag type inclusions were also found and again increased in size and frequency with shot number. A small amount of porosity was also present within the castings, but the overall microstructures are sound. The electrical conductivity measurements taken from the castings averaged 98% IACS and varied between 95% to 101% IACS. Samples were chemically analyzed for oxygen and iron contamination. The iron content varied from 10 ppm to 350 ppm and the oxygen levels from 0.06% to 0.15%.

TZM (Molybdenum Alloy) and Anviloy (Tungsten Alloy)

These alloys were considered for pressure die-casting of copper, but their high ductile-brittle transition temperatures threaten survival of molds, especially in the first few shots. The solution involved pre-heating the molds of these materials by electrical resistance heaters to over 600° C.

TZM and Anviloy alloys were machined into die sets. They were pre-heated according to the present invention to approximately 500° C. during the die-casting trial. Over 500 shots of molten copper were made with these die sets. A pre-heat temperature of 500° C. was been found to be sufficient in terms of avoiding heat-checking in TZM and Anviloy (i.e., it was apparent that the thermal shock of the molten copper was not exceeding the yield strength of these materials), but there was oxidation on TZM dies. That was discovered to be due to a liquid oxide being formed in the TZM material at approximately 700° C., a temperature that is easily attained during injection of the copper, compromising the integrity of the TZM mold and making TZM a less than ideal choice for copper die casting.

Nickel-based Superalloys

Die inserts were machined from Inconel alloys 617, 718 and 754. Over 250 die-castings were performed using these die sets, with the Inconel mold inserts pre-heated to at least 300° C. The Inconel 754 set began cracking very early (50 shots) into the run. This was somewhat surprising in that this particular alloy exhibits the highest strength at temperature of the three nickel-base alloys tested. But this alloy also has very low ductility at elevated temperature. The alloy with the lowest strength at temperature, Inconel alloy 718, began cracking after about 100 shots. The best performing alloy was the Inconel alloy 617, which exhibits the best combination of strength and ductility at elevated temperatures. Only minor craze cracking was evident on these die sets after 250 shots with the mold preheated to temperatures above 300° C.

Inconel 617, 625 and 601 alloys were then tested at a pre-heat temperature of 600° C.–650° C. No mold degradation was evident after 500 shots with these mold materials (the most promising of the Inconel mold materials tested to date). We found that a pre-heat temperature of approximately 650° C. was ideal in terms of avoiding heat-checking of the mold by reducing the $\Delta T$ between the molten copper and the die material, and hence the thermal shock, to a level below the yield strength of the mold material, and permitting cooling and solidifying in a commercially acceptable time frame. It was not necessary to heat the material any more than 650° C., since this would only have resulted in additional heating of the surrounding steel master mold, which requires cooling to prevent re-annealing, thereby causing unnecessary delays and reducing the throughput of the mold assembly. The master mold was actively cooled using water running through it in tubes, to prevent re-annealing of the steel. Molten copper was injected into the Inconel die inserts at finishing pressures ranging from 400 bar to over 800 bar. It was allowed to cool in the die from 10 to more than 25 seconds, whereupon the die set was open and the finished die-cast rotor was removed. The finished die-cast rotor was then either air cooled or immersed in a quenching tank filled with water to provide rapid cooling.

Inconel proved to be a suitable material for the mold inserts because of its high yield strength, its ability to maintain its integrity at high temperatures, and the fact that it is relatively inexpensive compared to other high performance materials such as Anviloy and related refractory metals.

These data provide an important clue towards solving this engineering problem, namely that a high ductility and high yield strength, or high fracture toughness at the surface temperature, may be important towards reducing the propensity to cracking and ultimately achieving extensive mold life-in-service.

Three copper castings made from Inconel were metallurgically, chemically and physically analyzed. Traces of iron, nickel and oxygen contamination were evident. Again, a small amount of microporosity was present within the castings, but the overall microstructures were sound. The electrical conductivity was better than that produced with the steel molds, nearly 100% IACS. To retain such high conductivity after melting in an open air environment and casting through a steel shot chamber into nickel molds is very promising, as this will allow the copper scrap to be completely recyclable within the foundry.

Inconel Alloy Dies

The Inconel insert set showed little degradation in the mold set with over 600 shots already run, using a pre-heat temperature of at least 600° C. After 300 shots, there was no evidence of cracking. Oxidation in and around the dies appeared self-limiting. Operating the dies at elevated temperature is absolutely essential toward improving the die life. The dies were operated at elevated temperature (600° to 650° C.) to reduce the thermal expansion and contraction associated with casting of molten copper and subsequent cooling, and to ensure that the thermal shock caused by the injection of the molten copper against the Inconel mold insert was below the yield strength for the Inconel. Limiting the cyclic expansion and contraction of the Inconel alloy helped decrease the thermal fatigue, leading to extended mold life. As a result, we found that a minimum pre-heat temperature of 600° C., and preferably up to 650° C. to account for irregularities in the die material which might cause a lower than theoretical yield strength was ideal. The use of high pre-heat temperatures with these high temperature, high performance die materials significantly increased the mold life making possible the die-casting of copper and other high melting point materials. Based on these results, a mold set incorporating a combination of nickel-base alloys and refractory alloys in the hottest portions will allow economical production of die-cast copper rotors.

The foregoing descriptions are presented to enable any person skilled in the art to make and use the described invention. Descriptions of specific applications or preferred embodiments of the features of the invention are provided only as examples.

Variations and/or modifications to the preferred embodiments will be readily apparent to those skilled in the art, and the general principals defined herein may be applied to other embodiments and applications without departing from the spirit and scope of the Invention. Thus, the unique features embodied within the present invention are not intended to be limited to the embodiments shown, but are to be accorded the widest scope consistent with the principles and features disclosed herein. Accordingly, it is not intended that the scope of the invention and unique features described above be limited by the above description but instead be determined entirely by reference to the claims that follow.

What is claimed is:

1. A method of die-casting, the method comprising the steps of:

providing a master mold having one or more mold inserts;

heating said one or more mold inserts to a predetermined temperature, wherein said predetermined temperature is at least 500 degrees Centigrade, but no less than the temperature at which the thermal shock on said one or more mold inserts caused by the difference in temperature between the molten material to be cast and said predetermined temperature is less than the lowest yield strength of said one or more mold inserts;

heating said material to be cast at least to a temperature at which said material to be cast is molten;

injecting said molten material to be cast into said one or more mold inserts;

allowing said molten material to be cast to cool to a temperature below its melting point.

2. The method according to claim 1, further comprising the step of placing the finished die-casting into a quenching tank to cool.

3. The method according to claim 1, wherein said one or more mold inserts form a motor rotor.

4. The method according to claim 1, further including the step of cooling the master mold by active heat removal.

5. The method according to claim 4, wherein the active heat removal includes forced air convection.

6. The method according to claim 4, wherein the active heat removal includes passing a liquid coolant through cooling tubes interconnected with the mold.

7. The method according to claim 4, wherein at least one of said one or more mold inserts include heaters for pre-heating said one or more mold inserts prior to injection of the molten material.

8. The method according to claim 1, wherein the material to be cast is copper.

9. The method according to claim 1, wherein the material to be cast is copper alloy.

10. The method according to claim 1, wherein the material to be cast is stainless steel.

11. The method according to claim 1, wherein the material to be cast is aluminum alloy.

12. The method according to claim 1, wherein the molten material is injected into said one or more mold inserts at a pressure of no less than 500 bar.

13. A method of die-casting a motor rotor, the method comprising the steps of:

providing a master mold having one or more mold inserts and an arbor extending through the interior of said one or more mold inserts;

inserting stacked laminations around said arbor;

heating said one or more mold inserts to a predetermined temperature wherein said predetermined temperature is at least 500 degrees Centigrade, but no less than the temperature at which the thermal shock on said one or more mold inserts caused by the difference in temperature between the molten material to be cast and said predetermined temperature is less than the lowest yield strength of said one or more mold inserts;

heating said material to be cast at least to a temperature at which said material to be cast is molten;

injecting said molten material to be cast into said one or more mold inserts;

allowing said molten material to be cast to cool to a temperature below its melting point.

14. The method according to claim 13, further comprising the step of placing the finished die-casting into a quenching tank to cool.

15. The method according to claim 14, further including the step of cooling the master mold by active heat removal.

16. The method according to claim 15, wherein the active heat removal includes forced air convection.

17. The method according to claim 15, wherein the active heat removal includes passing a liquid coolant through cooling tubes interconnected with the mold.

18. The method according to claim 15, wherein at least one of said one or more mold inserts include heaters for pre-heating said one or more mold inserts prior to injection of the molten material.

19. The method according to claim 18, wherein the material to be cast is copper.

20. The method of claim 19, wherein the mold inserts are Inconel.

21. The method according to claim 20, wherein the molten material is injected into said one or more mold inserts at a pressure of no less than 500 bar.

* * * * *